United States Patent [19]

Jakobsson et al.

[11] 4,450,899

[45] May 29, 1984

[54] METHOD OF REGULATING AN OUTDOOR STEAM CONDENSOR AND APPARATUS FOR PERFORMING SAID METHOD

[75] Inventors: Per-Olof Jakobsson, Söderköping; Sven Beverskog, Bromma, both of Sweden

[73] Assignee: Flakt Aktiebolag, Nacka, Sweden

[21] Appl. No.: 314,108

[22] Filed: Oct. 23, 1981

[30] Foreign Application Priority Data

Oct. 27, 1980 [SE] Sweden ..... 8007516

[51] Int. Cl.[3] ..... F28B 11/00; F28F 13/06

[52] U.S. Cl. ..... 165/39; 165/40; 165/96; 165/108; 165/DIG. 1

[58] Field of Search ..... 165/DIG. 1, 39, 40, 165/96, 99, 108, 122, 124, 98, 110, 111, 113

[56] References Cited

U.S. PATENT DOCUMENTS

| | | | |
|---|---|---|---|
| 3,223,152 | 12/1965 | Schulenberg | 165/124 |
| 3,443,633 | 5/1969 | Carnavos | 165/108 |
| 3,565,164 | 2/1971 | Kline et al. | 165/39 |
| 3,716,097 | 2/1973 | Kelp et al. | 165/39 |
| 3,967,916 | 7/1976 | Chittom | 165/39 |
| 4,240,499 | 6/1980 | Kals | 165/39 |
| 4,275,831 | 6/1981 | Smith | 165/39 |

FOREIGN PATENT DOCUMENTS

| | | | |
|---|---|---|---|
| 0004448 | 10/1979 | European Pat. Off. . | |
| 37480 | 3/1965 | Fed. Rep. of Germany | 165/DIG. 1 |
| 1476716 | 2/1966 | France | 165/101 |
| 55-92883 | 7/1980 | Japan | 165/DIG. 1 |
| 485187 | 3/1970 | Switzerland . | |
| 905914 | 9/1962 | United Kingdom | 165/124 |
| 904959 | 9/1962 | United Kingdom | 165/108 |
| 1333764 | 10/1973 | United Kingdom . | |
| 2008738 | 6/1979 | United Kingdom | 165/DIG. 1 |

OTHER PUBLICATIONS

*Power*, Nov. 1964, pp. 175–182, "Air Cooled Heat Exchangers", Steve Elonka, ed.

*Primary Examiner*—Sheldon J. Richter

*Attorney, Agent, or Firm*—Dann, Dorfman, Herrell and Skillman

[57] ABSTRACT

Method and apparatus for improving the operation of forced-air-cooled steam condensors having a bank of air-cooled heat exchangers connected between steam lines and condensate conduits. Air is forced through the heat exchangers by fans and shutters are provided to either discharge the spent air to atmosphere or to recirculate the spent air into the fan inlets to mix with fresh outside air. The steam pressure in the steam line is sensed along with the temperatures of the condensate in each exchanger and of outside air. The condensate conduits are in the recirculation path of spent air, and the fan is adjustable to control the quantity of air forced through the exchangers. By controlling the shutters and the fans in response to the pressure and temperatures, a highly-efficient cooling effect is achieved. According to the invention there are provided sensor-governed motor-driven roll-shutters (11), which more or less can screen the heat exchangers (12) and thereby create a recirculation channel (17) for the warmed up air, and there are furthermore provided sensor-governed adjustments of the blade angles of fans (13). The condensor (2) has an upper steam pipe-line (9) and connected thereto the heat exchangers (12), which preferably are arranged trapezoid-like in two parts covering the lower fans (13), one for each so called module, whereby a roll-shutter (11) is arranged outside of and at distance from each heat exchanger part, and whereby the roll-shutters are rolled up close to the steam pipe-line (9).

11 Claims, 7 Drawing Figures

Figure 1:
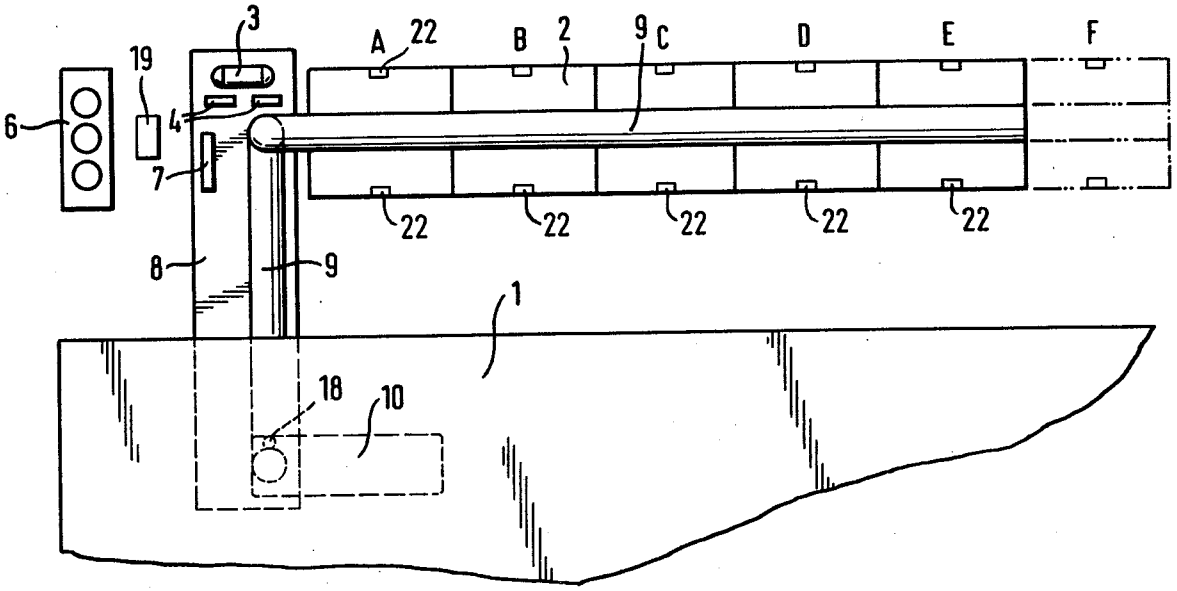

METHOD OF REGULATING AN OUTDOOR STEAM CONDENSOR AND APPARATUS FOR PERFORMING SAID METHOD

The present invention concerns a method of regulating the cooling of an outdoor steam condenser. Furthermore, the invention concerns an apparatus for accomplishing said method.

It has in many cases proved to be advantageous to place a condensor which is connected to a steam turbine outdoors and allow the outside air to cool the heat exchangers which are part of the steam condenser, for the purpose of condensing the steam. In that connection fans are used as an aid to suck in air and press it through the different batteries of the heat exchangers which are in the form of pipe coils or the like.

Known techniques in this field are revealed by EP-PA 79 300 428.4 (publication No. 0 004 448), CH-PS No. 485 187 (corresponding to U.S. Pat. No. 3,443,663) and GB-PS No. 1 333 764 (corresponding to U.S. Pat. No. 3,716,097).

A disadvantage with such arrangements is, that to a high degree they are dependent on weather conditions, for example snow, hail, rain, wind effect and outside temperature, which can cause undesired variations in the condensation pressure of the steam and condensate temperature, with resulting problems, particularly freezing with break-down of operation at low outdoor temperatures. Such disadvantages have not been easy to counteract.

For instance according to this European Patent Application, there has been proposed an arrangement of a number of fans, which are to be activated as required. Hereby, the temperature of the liquid to be cooled is sensed and the cooling effect is regulated only by increased or decreased ventilation which, of course, is totally unacceptable for steam condensors in cold climates, where the condensate or another liquid to be cooled soon will freeze with or without activated fans.

The Swiss Patent Specification shows and describes an air cooled steam condensor which, though useable in somewhat colder climates, nevertheless involves risks and especially a large, expensive and bulky surrounding equipment, which is susceptible to break-downs. Accordingly, a solid housing is required, which is rather objectionable, especially for reasons of costs. One has to imagine, that such a housing in a typical case will be 40 m long, 10–12 m high and 8–10 m wide. In this housing, there shall be arranged not less than five different flaps plus a valve, which arrangement naturally is susceptible to break-downs. A condensate conduit is located in a dead corner and is not substantially, if at all, affected by cooling air or circulating heated air and is mainly situated outside said housing, so that there is an immediate danger of freezing.

Also the approach as suggested by said British Patent Specification is objectionable, although certain progress has been made in relation to the two aforementioned solutions. Accordingly, the arrangement of flaps as screening elements, and under certain conditions diversion elements, of course, is a far more cheaper solution than building a big and costly and bulky housing. These flaps screen the heat exchangers more or less entirely, if they are to be used, and make a satisfactory flow of air worse or impossible, whereby substantial screening on the one side of the heat exchangers will substantially increase flow of air on the other side, as the space below the heat exchangers is hermetically closed except for an opening in which a fan is provided. The condensate conduits are exposed to extreme freezing risks, as only the initially-mentioned uncontrollable weather conditions have access to the condensate conduits. Furthermore, the flaps constitute a problem, as they firstly create noise, secondly throw back ventilation air towards the fan in certain conditions of operation, which hardly is desirable, and thirdly are exposed to enormous stress by wind in the outside location.

An object of the invention is to counteract and to eliminate as far as possible the aforementioned drawbacks and to improve the techniques in this field in a simple, cheap, effective and reliable way.

These objects are achieved according to the present invention in such a way, that the initially mentioned method is accomplished by recirculating the heated air from the heat exchangers past the condensation conduits. An apparatus for accomplishing said method provides shutters spaced from the heat exchangers to produce a recirculation channel for the heated air leading to the condensation conduits. Owing to these characteristics, the through-flow area of the condensor can with regard to cooling air be gradually changed as can also the recirculation air, which is driven by the fans through the heat exchangers. A relatively rapid and simple adoption to different conditions of operation and weather is thus obtained.

The procedure and the apparatus for its execution are revealed in more detail and more completely hereinafter.

In order to further explain the invention, a preferred embodiment is described below with reference to the accompanying drawings.

Figure 2:
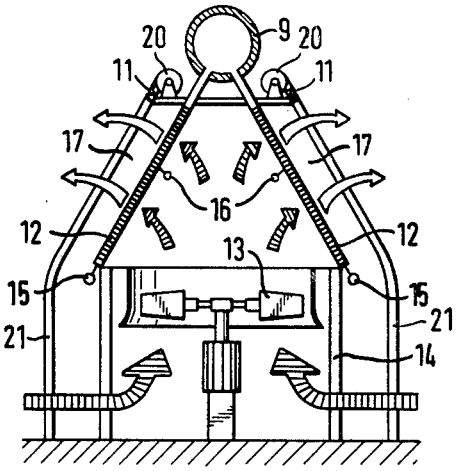
Figure 3:
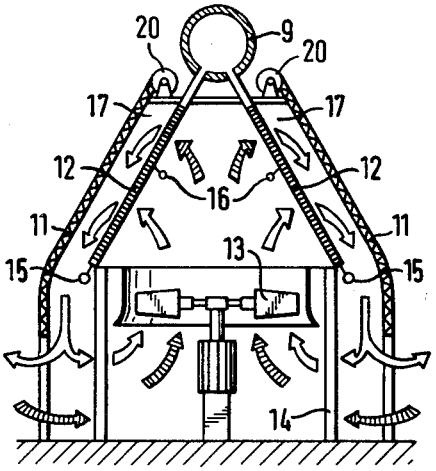
Figure 4:
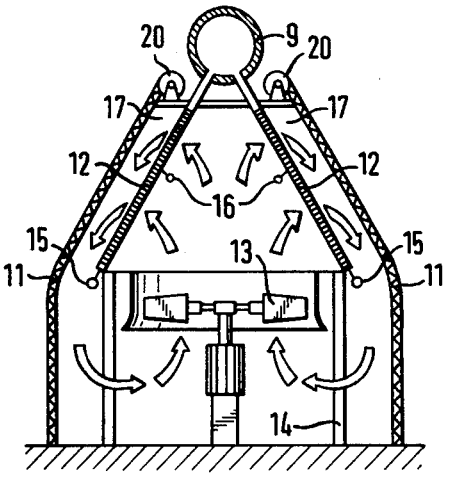
Figure 5:
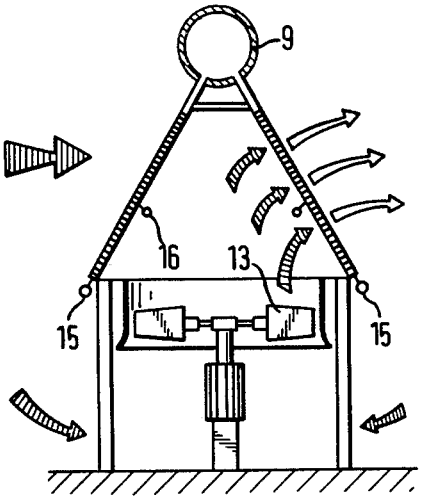
Figure 6:
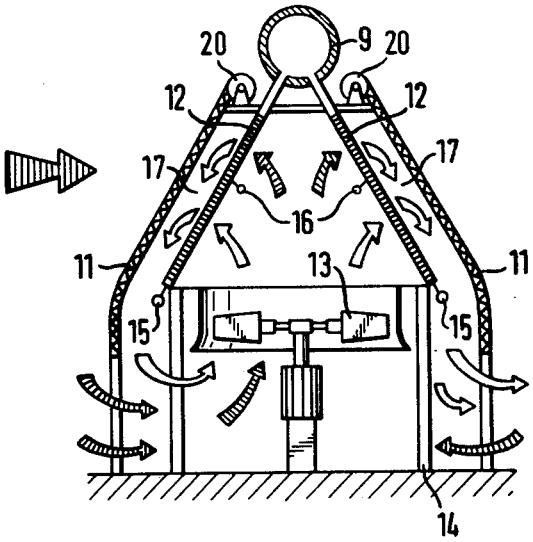
Figure 7:
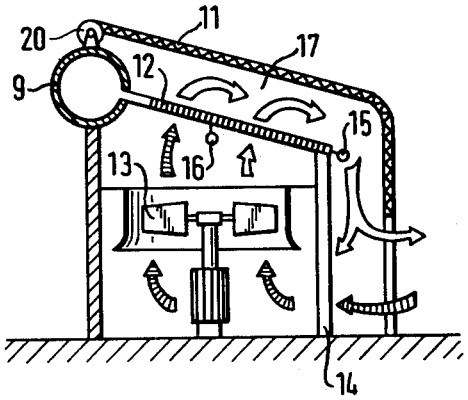

FIG. 1 is a schematic assembly view of the entire unit seen from above;

FIGS. 2, 3, 4 and 6 are cross-sectional views in large scale through the steam condensor according to the present invention during different weather conditions, FIG. 2 illustrating an operating position during high ambient temperature, FIG. 3 an operating position during low ambient temperature, FIG. 4 an operating position during extremely low ambient temperature and FIG. 6 an operating position during wind attack from the side;

FIG. 5 shows the air flow conditions around the heat exchanger in the case when roll-shutters are missing and a wind attack occurs from the side; and FIG. 7 shows a simpler embodiment of an apparatus according to the invention, also in a schematic cross section.

In FIG. 1, which schematically shows the unit from above and its orientation in respect to a factory building, the following reference numerals have been used: 1 designates a factory building, 2 a modular steam condensor, 3 a condensation tank, 4 condensate pumps, 6 a cooling water cooler, 7 an operating ejector, 8 a culvert or drainage conduit, 9 a steam pipeline, 10 a turbine, 18 a pressure sensor arranged at the outlet of said turbine, 19 an outdoor temperature sensor and 22 condensate temperature sensors at the modules A–F of the condensor.

In FIG. 2, a module is shown including the steam pipe 9, roll-shutters 11, heat exchangers 12, fan 13, a stand 14 which supports the heat exchangers and the steam pipe, condensate conduits 15, conduits 16 for evacuation of air leading to the ejector 7 (FIG. 1), recirculation air channels 17, roll-shutter motors 20 and roll-shutter guide elements 21.

In FIGS. 2–6, the direction of the air flow has been indicated with arrows in the vicinity of the heat exchangers and the fan. It is shown by FIGS. 2–4, that the lower the outside temperature is, the more the roll-shutters are rolled downward over the heat exchangers, whereby an increased recirculation of the heated air occurs, which is favorable for the compensation of the increasing cooling capability of the air and therewith the avoidance of problems in connection with freezing at lower temperatures.

FIGS. 5 and 6 show the conditions during wind attack from the side. On the one hand, if roll-shutters are not included the effect is as in FIG. 5, and on the other hand with the shutters partially rolled down according to the invention, as in FIG. 6, the effect is a considerably more even distribution and increased recirculation of the air currents blown in by the fan.

In the following text, the procedure according to the invention will now be described in the way, that it suitably can be accomplished using the unit shown in the drawing.

The condensation pressure of the steam shall "be held at a constant" of 0.1 bars ABS (45° C.). The condensation effect is dependent on pressure which is why even changes of load affect the condensation pressure.

1. A pressure transmitter 18 located at the outlet of the turbine affects the total flow air flow during falling pressure, by decreasing the blade angle of the fans from 33° down to 10° at the lowest, which occurs by means of an automatic adjusting device in the fan which device is known per se and not shown. All of the fans are regulated in parallel by the transmitter 18.

2. If the condensate in any of the batteries or modules becomes cooler than 40° C., the temperature transmitters 22, located one in each battery, will decrease the flow of air in the affected cooling module, by decreasing the blade angle of the fan down to a minimal 10°. All of the cooling modules are to be effected individually by the transmitters 22.

3. If under point 1 the pressure still is too low, the cooling effect of the air flow is further decreased by the shutters screening off the batteries for each cooling module.

4. If the condensate under the conditions of point 3 become colder than 40° C., the shutters, by impulse of the temperature transmitters 22, screen off the battery area of the cooling module in question to the degree required.

5. When the outside temperature falls below 0° C. the shutters, independent of the condensation pressure, are to screen off the entire frontal area of the batteries. The warm air flow is in this case directed entirely downward. The fans now draw a mixture of cold and warm air. If the condensation pressure tends to increase, the blade angle of the fans is at first hand increased to the maximum of 33°, after which the screening of the batteries is decreased by rolling up the shutters.

6. During falling condensation pressure under point 5, the blade angle of the fans is at first hand, decreased down to −4° (negative angle), after which the shutters decrease the inward flow area of outside air from positional setting 0° C. down to completely closed shutters (shutters rolled down to ground level).

7. The shutters in the same module are to be capable of being manually operated in parallel operation.

8. The blade angles of the fans are capable of being individually regulated from a control room.

9. An alarm from the temperature transmitter 22 in each battery is given if the condensation temperature falls below 30° C.

10. Also, an outdoor temperature sensor 19 can affect both the blade angles and the shutters.

It is quite obvious, that the roll-shutters according to the present invention, with suitable location and inclination in relation to the horizontal plane, for example in the manner that they are made according to the embodiments shown here, even serve as protection especially during suddenly occuring precipitation such as snow or rain but the steam condensor can of course also be provided with a roof, which leaves free admission of air from the sides. As shown in FIG. 7, a simpler embodiment of an apparatus according to the invention may comprise a shed-roof-like heat exchanger battery 12' which is a suitable solution for small plants. In other respects, such apparatus can be equipped and can function correspondingly to the embodiment previously shown and described.

As indicated in FIGS. 2–7, cool or fresh air is indicated by the shaded arrows and recirculated or warmed air is indicated by the plain arrows. The curtains formed by the shutters are transverse to the flow area of the heat exchangers and form channels which extend from the steam line 9 towards the condensate conduits 15. As shown the length of the curtain determines the amount of warm air which flows past the conduits 15 and is recirculated by the fan 13, and thereby the respective amounts or proportion of outside and recirculated air.

We claim:

1. A method of regulating cooling of an outdoors-air-cooled steam condensor having heat exchangers with an air flow area and fan means to blow air outwardly through the entire air flow area of the heat exchangers, said condensor being fed by steam-line and being connected to discharge into condensate conduits, the improvement comprising the steps of providing screening and diversion shutter elements forming a curtain transverse to the direction of air flow through the air flow area of and spaced from the heat exchangers at a distance on the outside for diverting the outward flow and providing an air recirculation channel starting from the vicinity of said steam-line and extending along the outside of said heat exchangers towards said condensate conduits, and using said curtain to divert the outward flow to follow said channel and flow toward said conduits without substantially diminishing the flow through the heat exchanger, sensing the condensation pressure of the steam, the condensate temperature, and the outdoor air temperature, positioning the inlet of the fan means downstream of said conduits in the direction of the recirculation flow so that the flow from said channel passes said conduits and is recirculated into said fan, and regulating both the length of the curtain and the blowing of said fan means to keep the condensation pressure at a substantially constant value and the condensate temperature above freezing, the length of the curtain controlling the amount of the recirculated air, and the fan controlling the total quantity of air passing through the heat exchangers.

2. A method according to claim 1, wherein the condensor has a plurality of heat exchanger modules and a separate fan means and shutter elements for each module, and including the step of regulating the flow of air in response to falling condensation pressure, by decreasing the flow of the fans from a highest value toward a first lower value simultaneously for all modules and in response to the temperature of the condensate in any of the modules falling under a prescribed value reducing the flow of air to that module down to the aforementioned first lower value.

3. A method according to claim 2, wherein, in response to the condensation pressure and/or condensate temperature remaining below said prescribed value after diminishing the flow to the first lower value, the regulating step includes diminishing the intake of atmospheric air by increasing the length of the curtain provided by said shutters.

4. A method according to claims 1, 2, or 4 including the steps in response to the outdoor temperature falling under a prescribed value, of increasing the length of said curtain to screen the entire flow area of said heat exchangers, and to divert all of the heated air emerging from the heat exchangers into the inlet of the fan means to impinge on and be united with cold air sucked in by the fan means, and upon increase of the condensation pressure, of first increasing the flow of the fan means to the highest value, and thereafter reducing the length of the curtain; then upon lowering of the condensation pressure first reducing the flow of the fan means to a second lower value, and thereafter increasing the length of the curtain toward maximum screening by the shutter elements.

5. A method according to claim 1 wherein the condensor has a plurality of modules and a separate fan means and shutter elements for each module, and including the step of regulating in each module both the shutters and the blade angle of the fan manually both in synchronous operation and individually.

6. An apparatus for improving the operation of an outdoor-air-cooled steam condensor with heat exchangers arranged on a support, said exchangers having an air flow area and fan means for blowing air outwardly through said air flow area, said exchangers being fed by a steam-line at one side of said flow area and leading into condensate conduits at the other side of said flow area, control means for reducing the risk of freezing comprising screening and diversion means consisting of motor-driven roll-type shutters forming a curtain transverse to the direction of air flow through said air flow area and spaced from the heat exchangers to form at the outer side an air recirculation channel starting from the vicinity of the steam-line at said one side and diverting warmed-up air currents towards said condensate conduits at said other side, and means to adjust the extension of said shutters both in steps and continuously, the intake of said fan means being downstream of said conduits in the direction of recirculation flow so that warmed-up air currents are recirculated through the fan means after being passed over said conduits.

7. An apparatus according to claim 6, wherein the steam condensor comprises a plurality of modules each containing an adjustable fan and at least one heat exchanger with coils for steam condensation, said steam line being above said heat exchanger, said shutters being arranged to form said channel to extend across the flow area of said heat exchanger obliquely down-ward and out-ward from the steam line, the inlet of the fan being located below said heat exchanger and positioned to withdraw air from below said heat exchanger and to press it up through the heat exchanger.

8. An apparatus according to claim 6 or 7, including means to adjust the shutters to control the length of the recirculation channel extending from said one side across the flow area, and means to adjust the flow of the fans.

9. An apparatus according to claim 8 including a pressure sensor for the steam condensation pressure and a condensate temperature sensor, and an outdoor temperature sensor and connections from said sensing means to said adjusting means to change the flow of the fans and the length of the shutter curtain and thereby control the recirculation of warmed up air from the fans through the heat exchangers in response to changes in said pressure and temperatures.

10. An apparatus according to claim 10 wherein said steam-line is supplied by a turbine and said pressure sensor is at the outlet of said turbine.

11. An apparatus according to claim 7 wherein said fan is an axial fan having blades and means to adjust the blade angle both in steps and continuously.

* * * * *

UNITED STATES PATENT AND TRADEMARK OFFICE

CERTIFICATE OF CORRECTION

PATENT NO. : 4,450,899

DATED : May 29, 1984

INVENTOR(S) : Per-Olof Jakobsson and Sven Beverskog

It is certified that error appears in the above-identified patent and that said Letters Patent is hereby corrected as shown below:

Column 1, line 20, "3,443,663" should read --3,443,633--;
Claim 4, line 4, "4" should read --3--;
Claim 10, line 1, "10" should read --9--;
Claim 11, line 1, "7" should read --6--.

Signed and Sealed this

*Nineteenth* Day of *March 1985*

[SEAL]

*Attest:*

DONALD J. QUIGG

*Attesting Officer* *Acting Commissioner of Patents and Trademarks*